US006305210B1

(12) United States Patent
Saunders et al.

(10) Patent No.: US 6,305,210 B1
(45) Date of Patent: Oct. 23, 2001

(54) ONE-PIECE CAN BODIES FOR PRESSURE PACK BEVERAGE CANS

(75) Inventors: William T. Saunders, deceased, late of Weirton, by Cleo Saunders, executrix; William H. Dalrymple, Weirton, both of WV (US)

(73) Assignee: Weirton Steel Corporation, Weirton, WV (US)

( * ) Notice: Subject to any disclaimer, the term of this patent is extended or adjusted under 35 U.S.C. 154(b) by 1019 days.

(21) Appl. No.: 08/695,554

(22) Filed: Aug. 12, 1996

Related U.S. Application Data

(63) Continuation-in-part of application No. 08/303,660, filed on Sep. 9, 1994, now abandoned, and a continuation-in-part of application No. 08/053,458, filed on Apr. 17, 1993, now Pat. No. 5,347,839, and a continuation-in-part of application No. 08/573,548, filed on Aug. 27, 1990, now Pat. No. 5,119,657, said application No. 08/303,660, is a continuation-in-part of application No. 08/269,687, filed on Jul. 1, 1994, now Pat. No. 5,647,242, which is a division of application No. 07/596,854, filed on Oct. 12, 1990, now Pat. No. 5,343,729, which is a continuation-in-part of application No. 06/831,624, filed on Feb. 21, 1986, now Pat. No. 5,014,536, which is a continuation-in-part of application No. 06/712,238, filed on Mar. 15, 1985, now abandoned, said application No. 08/053,458, is a division of application No. 07/490,781, filed on Mar. 8, 1990, now Pat. No. 5,209,099.

(51) Int. Cl.[7] ..... B21D 51/26

(52) U.S. Cl. ..... 72/348

(58) Field of Search ..... 72/347, 348, 349

(56) References Cited

U.S. PATENT DOCUMENTS

| | | | | |
|---|---|---|---|---|
| 3,998,174 | * | 12/1976 | Saunders | 72/349 |
| 4,289,014 | * | 9/1981 | Maeder et al. | 72/348 |
| 4,407,149 | * | 10/1983 | Smith et al. | 72/47 |
| 4,584,859 | * | 4/1986 | Saunders | 72/349 |
| 4,685,322 | * | 8/1987 | Clowes | 72/348 |
| 5,325,696 | * | 7/1994 | Jentzsch et al. | 72/117 |

* cited by examiner

*Primary Examiner*—Lowell A. Larson
(74) *Attorney, Agent, or Firm*—Shanley & Baker

(57) ABSTRACT

Method and apparatus are disclosed for fabricating a one-piece can body, with profiled closed end, from flat rolled steel of selected thickness gauge and tensile strength. Such steel substrate is electrolytically metal plated to facilitate sidewall ironing into an elongated sidewall can body for pressurized beverage packs. An axially-recessed bead is formed in the endwall of a drawn cup by pulling sidewall metal for movement into such endwall. That preformed bead being symmetrically positioned in the drawn cup such that a bodymaker redraw of the drawn cup positions sheet metal of the preformed bead so as to constitute a closed end angled portion, which extends from a circular configuration base support toward contiguous sidewall. Following subsequent sidewall ironing of the bodymaker redrawn cup, a substantially-planar endwall panel, radially inward of such base support, is formed into a concave dome by moving sidewall sheet metal into the closed end of the sidewall ironed can body, thus substantially avoiding thinning of closed end sheet metal and providing desired bulge and implosion resistance. Also, reforming steps for such closed end, subsequent to can body fabrication, are eliminated.

5 Claims, 10 Drawing Sheets

ONE-PIECE CAN BODIES FOR PRESSURE PACK BEVERAGE CANS

This application is a continuation-in-part of co-owned U.S. application Ser. No. 08/303,660, entitled ONE-PIECE CAN BODIES FOR PRESSURE PACK BEVERAGE CANS, filed Sept. 9, 1994, (now abandoned) which is a continuation-in-part of co-owned U.S. application Ser. No. 08/269,687, (now U.S. Pat. No. 5,647,242) entitled FABRICATING ONE-PIECE CAN BODIES WITH CONTROLLED SIDEWALL ELONGATION, filed Jul. 1, 1994, which is a division of U.S. application Ser. No. 07/596,854, SAME TITLE, filed Oct. 12, 1990, (now U.S. Pat. No. 5,343,729) which was a continuation-in-part of co-owned U.S. application Ser. No. 06/831,624, (now U.S. Pat. No. 5,014,536) entitled DRAWN CAN BODY METHODS, APPARATUS AND PRODUCTS filed by the present applicant Feb. 21, 1986 which was a continuation-in-part of co-owned U.S. application Ser. No. 06/712,238, SAME TITLE, filed Mar. 15, 1985 (now abandoned); and U.S. application Ser. No. 07/573,548 entitled DRAW-PROCESSING METHODS, SYSTEMS AND TOOLING FOR FABRICATING ONE-PIECE CAN BODIES filed by the present applicant on Aug. 27, 1990 (now U.S. Pat. No. 5,119,657); and a continuation-in-part of co-owned U.S. application Ser. No. 08/053,458 entitled DRAW-PROCESS METHODS, SYSTEMS AND TOOLING FOR FABRICATING ONE-PIECE CAN BODIES, filed Apr.17, 1993 (now U.S. Pat. No. 5,347,839), which is a division of U.S. application Ser. No. 07/490,781, SAME TITLE, filed Mar. 8, 1990 (now U.S. Pat. No. 5,209,099).

This invention relates to sheet metal can bodies and to methods and apparatus for fabricating sidewall elongated one-piece can bodies from flat-rolled sheet metal. More specifically, this invention is concerned with preforming sheet metal at the closed end of a cup-shaped work product so as to enable effective and efficient profiling of a decreased diameter base support for the closed end of a sidewall elongated can body which is suitable for pressurized beverage packs. In particular, this invention provides for profiling the closed end of a can body of selected tensile strength flat-rolled steel, free of sheet metal buckling during such profiling, while maintaining desired bottom wall thickness gauge so as to avoid bulging or implosion at such closed end during usage.

Difficulties in consistently fabricating flat-rolled sheet metal one-piece can bodies to provide satisfactory closed end profiling for pressurized beverage packs have long been associated with ironed sidewall one-piece can bodies. The height of a sidewall-ironed one-piece can body for a pressurized beverage pack significantly exceeds can body diameter; and, a significant percentage of that sidewall height is achieved by sidewall ironing. However, fabricating a one-piece can body with acceptable sheet metal economies to provide an ironed sidewall, and a desired closed end configuration which does not require reforming after can body fabrication, has continued to present significant challenges to the canmaking industry notwithstanding the billions of pressure pack beverage cans manufactured and distributed annually in recent years.

Teachings which effectively and efficiently overcome those challenges are considered in more detail in describing specific embodiments of the invention, as shown in the accompanying drawings, in which.

Figure 13:
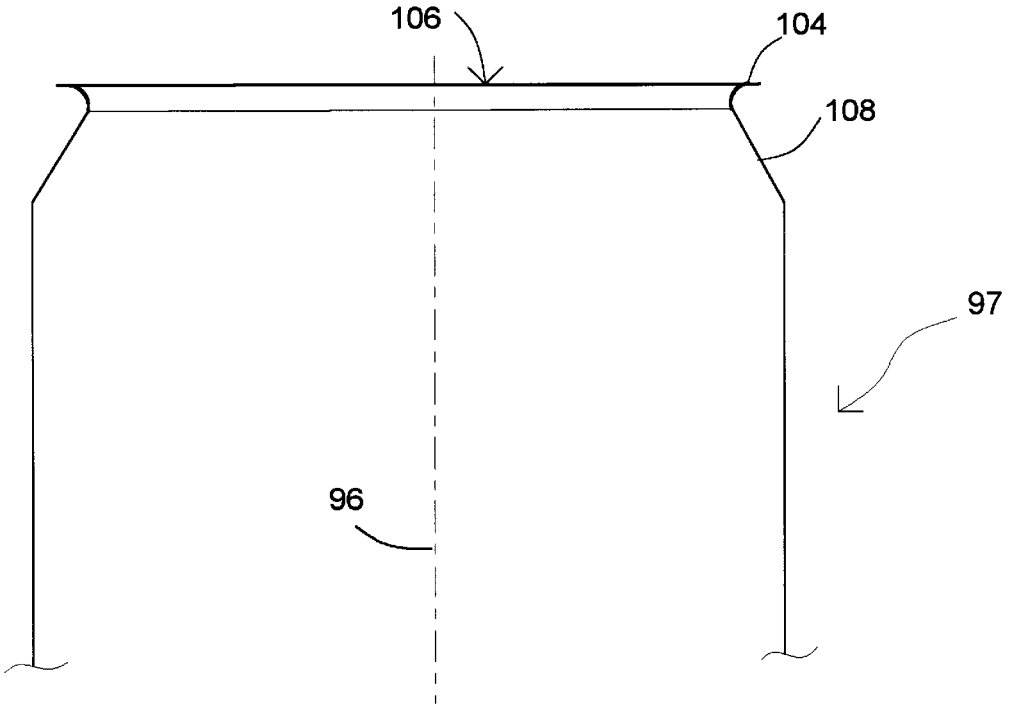
Figure 14:
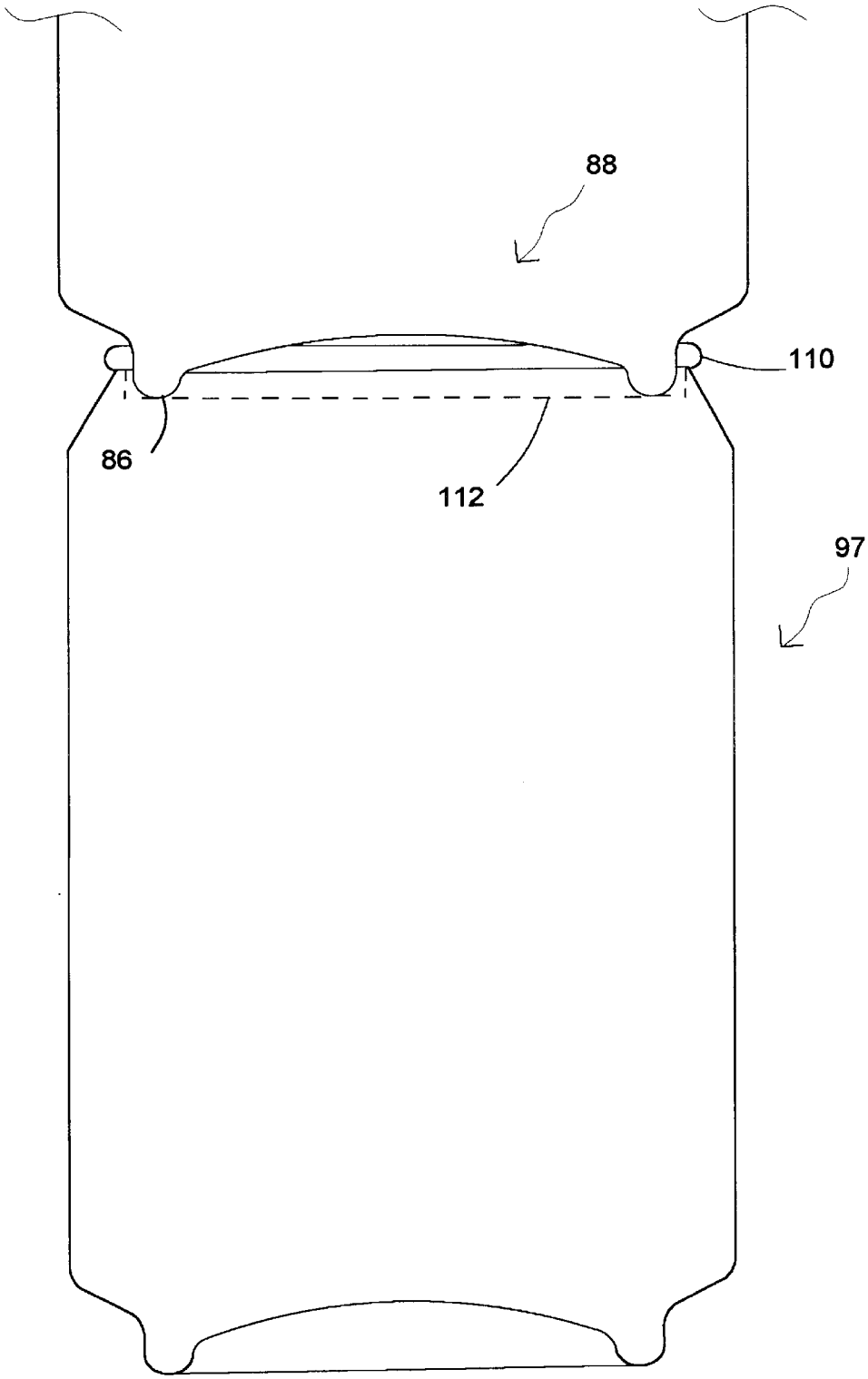

FIG. 13 schematic partial view, in axially-oriented cross section, at the open end of the can body, for describing necking-in dimensioning and flange metal formation for chime seam attachment of a preselected diameter end closure structure of the invention; and FIG. 14 is a schematic partial view, in axially-oriented cross section, showing the preselected diameter of a closed end base support for a pressurized beverage pack of the invention which will interfit within a chime seam, formed from the flange metal of FIG. 13 for the preselected end closure, so as to provide desired stacking characteristics for pressure packs assembled from such can bodies.

Figure 1:
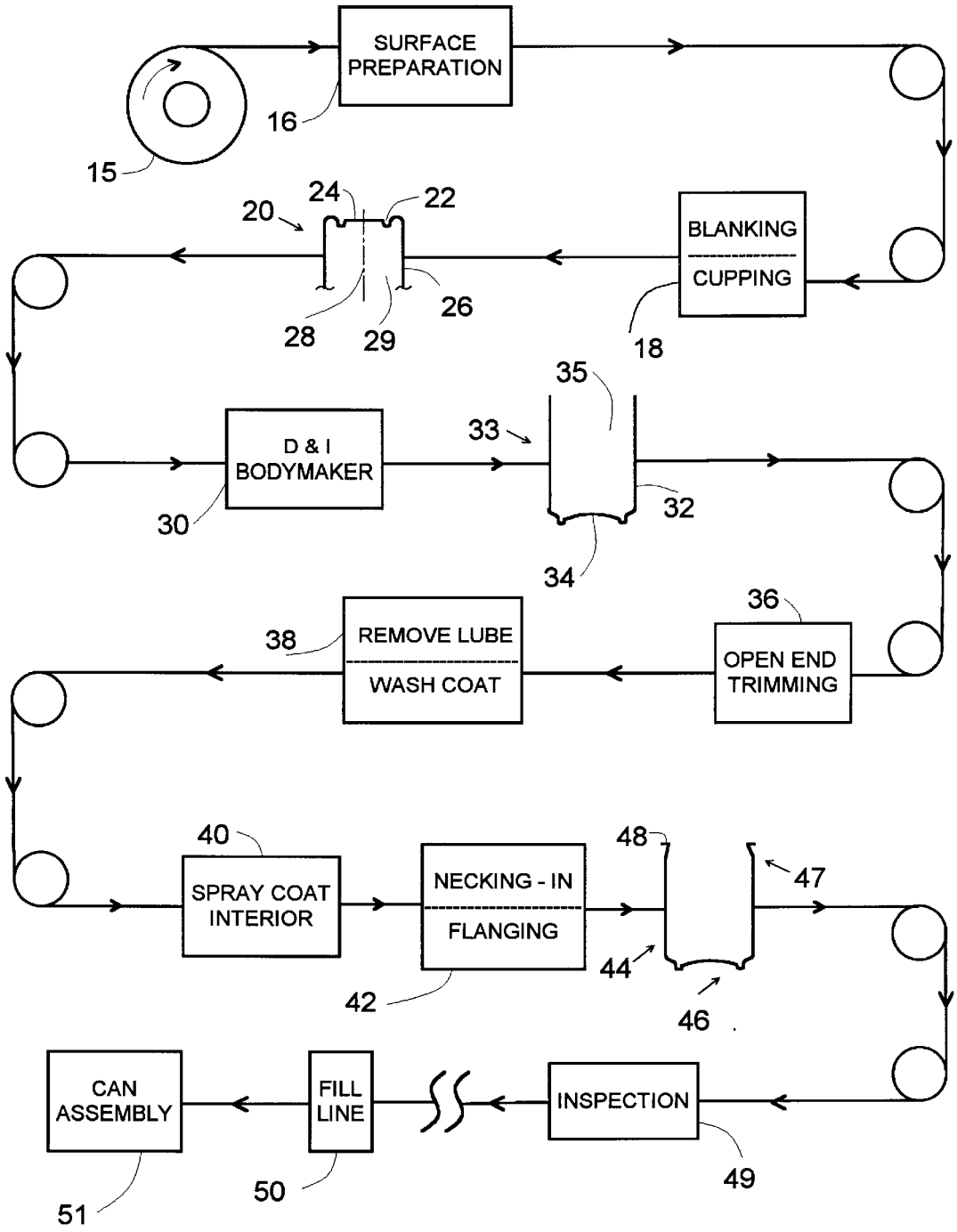
FIG. 1 is a diagrammatic general-arrangement presentation for describing the overall processing of the invention for fabricating one-piece can bodies for pressurized beverage packs.

Referring to FIG. 1, flat-rolled sheet metal of preselected tensile strength and nominal thickness gauge is provided in continuous-strip form at roll 15. In a preferred embodiment, double-reduced flat-rolled steel substrate is provided in a thickness range of about sixty to about ninety-five lbs/base box (#/bb).

The flat-rolled sheet metal is prepared for processing at station 16, with preparation including surface cleansing of debris and removal of surface oxidation. Also, as part of surface preparation, the flat-rolled steel substrate of the preferred embodiment is plated electrolytically with a metal, such as tin or nickel/zinc, which will facilitate sidewall elongation of steel substrate by ironing.

Surface prepared flat-rolled sheet metal can be precut into blanks for feeding to a cup-forming apparatus. However, in the embodiment of the general arrangement of FIG. 1, the electrolytically metal-plated flat-rolled steel is fed directly into a blanking and cupping apparatus, as shown and described in more detail in copending and co-owned application Ser. No. 08/155,511, filed Nov. 22, 1993, which is included herein by reference. In the illustrated embodiment of FIG. 1, a circular blank is cut and draw-formed at a single station, such as 18, into a shallow-depth cup-shaped work product 20.

A closed endwall and a contiguous sidewall portion are shown in the cross section of product 20. Size and locational placement of a bead preform 22 in the endwall of drawn product 20 are significant factors in enabling profiling of the closed end for a pressurized beverage can body with the advantages of the invention. Bead 22 is recessed toward the interior of cup-shaped work product 20 and bead 22 circumscribes a centrally-located endwall panel 24 which is substantially planar.

Sidewall 26 extends, in symmetrical relationship to a centrally-located longitudinal axis 28, toward open end 29 of the work product 20. The invention also teaches that recessed bead 22 can be formed intermediate such draw operation at station 18 and a subsequent redraw in D&I bodymaker 30.

Bead 22 can have a symmetrical configuration in cross section and is of circular configuration in plan view. Bead 22 is selectively spaced radially inwardly of, and uniformly from, a projection of the cylindrical periphery of sidewall 26 onto the plane which includes such centrally-located panel 24.

In drawing and ironing bodymaker 30, work product 20 is redrawn while mounted on a uniform-diameter "redraw punch" which serves to maintain the same axial alignment with that of cup 20 and throughout the D&I operation by also serving as an "ironing punch" after cup sidewall 26 has been increased in height by decreasing the diameter of cup 30. After the cup-shaped work product is redrawn, the redrawn cup-shaped product is driven through ironing means, such as a series of ironing rings each of decreasing inner diameter, as the height of redrawn sidewall is progressively increased by progressively decreasing the thickness gauge of the bodymaker redrawn cup sidewall sheet metal. A more detailed description of ironing rings and sidewall ironing is available in Saunders, et al. U.S. Pat. No. 4,457,150, issued Jul. 3, 1994, entitled "METHOD OF FORMING D&I CANS FROM COATED STEEL," which is incorporated herein by reference.

By practice of the invention, sheet metal at the closed end of the work product is maintained substantially at starting thickness gauge during redraw and as sidewall is ironed in the bodymaker. Electrolytic metal plating of flat-rolled steel substrate, with a metal such as tin or nickel/zinc, enables sidewall ironing of the flat-rolled steel substrate. And the bodymaker operations can be carried out with the longitudinal axis of the can body being oriented either horizontally or vertically.

The height of sidewall 32 of bodymaker drawn and ironed can body 33 has been increased and its thickness gauge has been decreased. Sheet metal of dome-shaped endwall 34 (FIG. 1) is maintained substantially at starting thickness gauge in accordance with present teachings. The open end 35 of can body 33, after sidewall ironing, can present an uneven edge resulting from being driven through sidewall ironing rings. Sheet metal at open end 35 is trimmed to a uniform sidewall height at station 36 of FIG. 1.

The can body is cleaned so as to be free of ironing lubricant; protective wash coat can be applied, for example externally, and the product is dried as part of the operations at processing station 38. The sequence of such steps after can body fabrication can vary within the scope of the present invention. Organic coatings for the internal surface of can bodies for use with comestibles are subject to approval in the U.S. by the U.S. Food and Drug Administration, and are available commercially from suppliers such as: The Valspar Corporation, 1501 Reedsdale Street, Pittsburgh, Pa. 15233 or Dexter Packaging Products, East Water Street, Waukegan, Ill. 60085.

Interior surfaces of the can body 33 are coated with an organic polymeric coating, for example by spray coating at station 40. Necking-in to enable receiving a preselected diameter easy-open end closure, as taught herein, and open end flange formation are carried out at station 42 of FIG. 1. The resultant can body 44 includes profiled closed end 46, necked-in open end 47, and seaming flange 48. Can body 44 is ready for inspection, filling and assembly which can be carried out at stations 49, 50, and 51 respectively.

Figure 2:
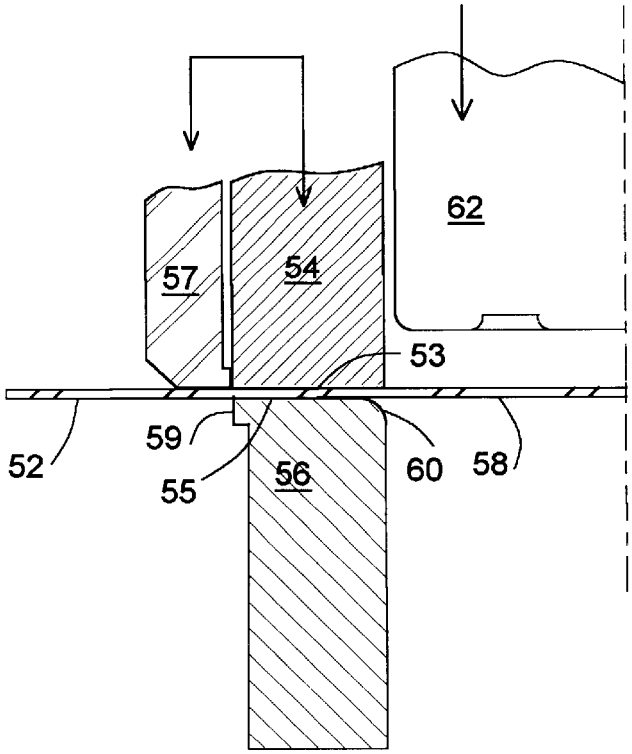
FIG. 2 is a partial view, in radially-oriented cross section, of tooling for carrying out a blanking step for cutting a sheet metal blank prior to cup formation in one embodiment of the invention.

Specific embodiments of can body fabricating for carrying out the invention are shown in more detail in subsequent FIGS. 2–11. In FIG. 2, a portion of sheet metal 52 is clamped between planar surface 53 of clamping tool 54, and planar surface 55 of draw die 56, as cutting tool 57 moving as indicated, severs a preselected diameter blank 58 at cutting edge 59.

Figure 3:
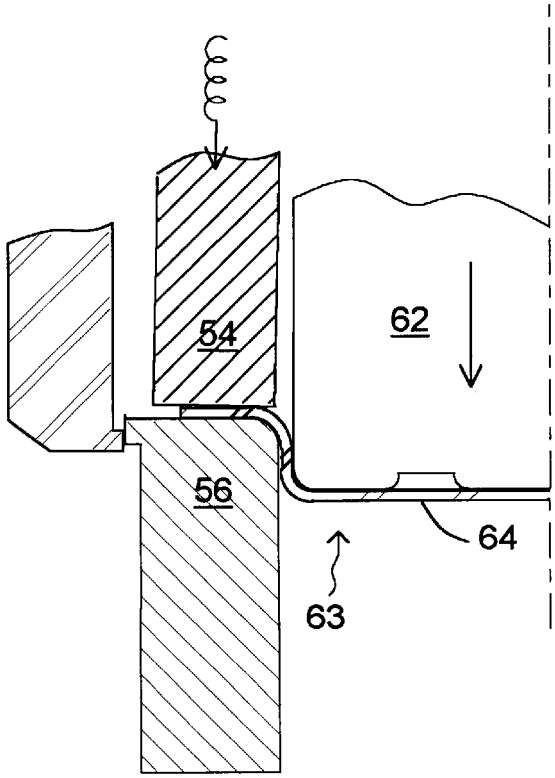
FIG. 3 is a partial view, in radially-oriented cross section, of tooling during cup formation of a cut blank of FIG. 2.
Figure 4:
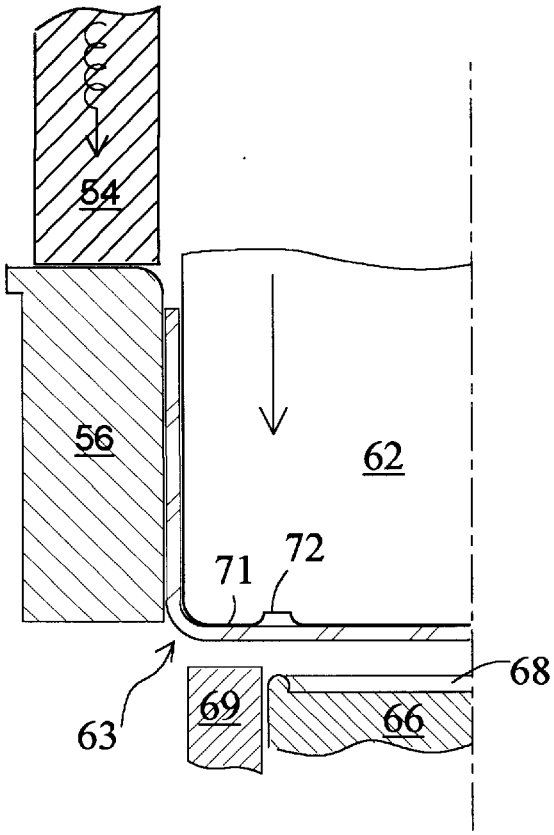
FIG. 4 is a partial view, in radially-oriented cross section, of tooling upon completion of draw formation of a cup-shaped work product of the invention.

Draw die 56 presents a curved surface entrance zone 60 (as best seen in the radial cross-sectional view of FIG. 2) into which the cut blank 58 is drawn. Referring to FIG. 3, draw punch 62 moves as indicated, subsequent to the cutting of blank 58, to draw-fabricate a one-piece cup-shaped work product 63 having closed endwall 64. Completing the draw of the cup-shaped work product mounted on draw punch 62 is shown in FIG. 4. Draw punch 62, moving as indicated in FIG. 3, moves sheet metal forming the cup into the die cavity provided by draw die 56.

The axially-recessed bead 22 of FIG. 1 can be formed in the cupping press or can be formed while en route to D&I bodymaker 30. As draw is completed in FIG. 4, externally-mounted endwall preform tooling 66 (shown in FIGS. 4, 5) provides for forming an axially-recessed circular-configuration bead in the endwall of the drawn work product.

Figure 5:
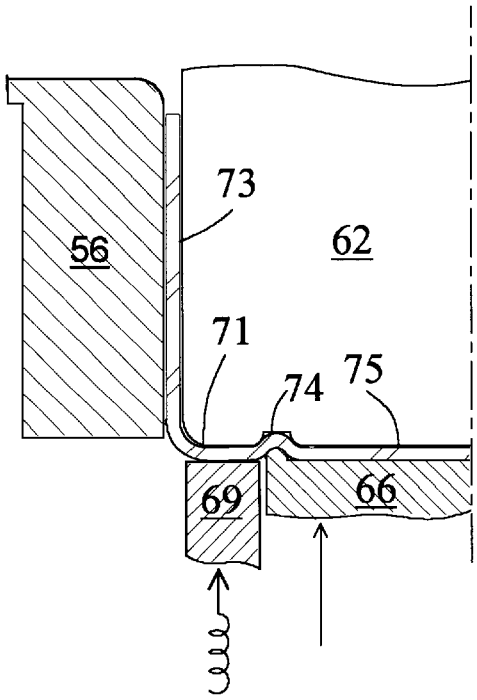
FIG. 5 is a cross-sectional view showing tooling of the invention forming an axially-recessed circular-configuration bead in endwall sheet metal subsequent to draw formation of the cup-shaped work product initiated in FIG. 3.

Male preform protrusion 68 has a circular configuration in plan view and projects from tooling 66 about its periphery, as shown in FIG. 4. Sleeve 69 is merely spring-loaded, acting as a concentric guide for tooling 66 and selectively clamping sheet metal at a peripheral portion (71) of the drawn cup. Sleeve 69 guides sheet metal, as sidewall metal is pulled into the endwall for forming a recessed bead, as shown in FIG. 5. Such a recessed bead could also be formed as described earlier in relation to FIG. 1.

Forming of the recessed bead is carried out as shown in FIG. 5. A radially outwardly-located endwall portion 71 is preselected and extends radially, from the location of axially-recessed opening 72 to a unitary juncture with sheet metal of drawn cup sidewall 73. The male member 68 of tooling 66 and axially-recessed opening 72 are axially aligned; and the contact of each with the sheet metal of the drawn cup endwall presents a circular configuration in plan view, forming a circular-configuration axially-recessed bead 74, as shown in FIG. 5. A substantially-planar endwall panel 75 is established radially inwardly of recessed bead 74 with endwall portion 71 being located radially outwardly of bead 74, as shown in FIGS. 5, 6, 7.

In accordance with teachings of the invention, sheet metal of drawn cup sidewall 73 is guided by spring-loaded guide 69 in the direction of the drawn cup endwall as bead 74 is formed. That is, the height of redrawn cup sidewall 73 is decreased by approximately the linear dimension of the sheet metal in bead 74, less the linear dimension of that portion of endwall sheet metal which had spanned opening 72 before forming bead 74.

Sheet metal tensile strength, such as double-reduced flat-rolled steel, selected for application of the invention, facilitates movement of sidewall sheet metal toward the endwall as male preform tooling 68 moves into recessed opening 72, as shown in FIG. 5; thus bead 74 is formed by decreasing the height of drawn cup sidewall 73 not by thinning endwall metal. That is, substantially-uniform sheet metal starting thickness gauge is maintained in closed end portions during fabricating.

Figure 6:
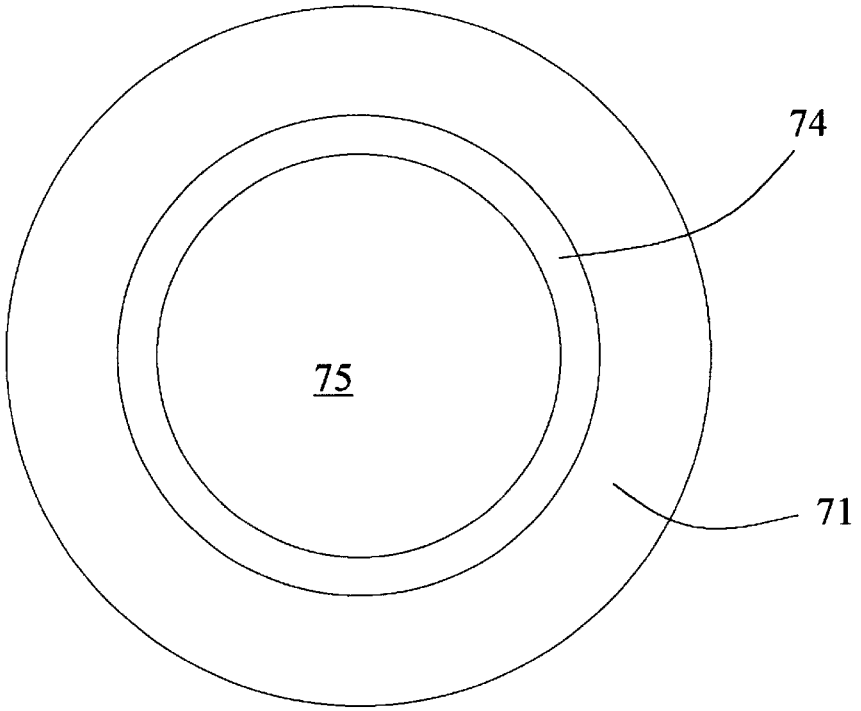
FIG. 6 is a bottom plan view of the drawn cup-shaped work product of the invention for describing preselected location of a recessed bead preform as shown in FIG. 5.
Figure 7:
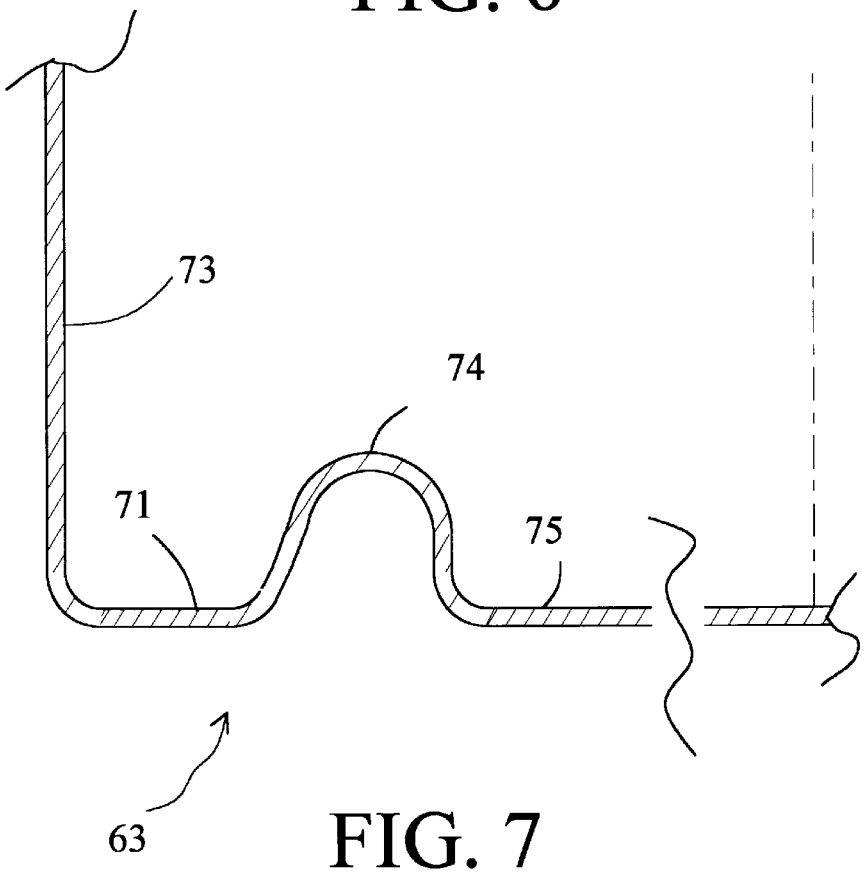
FIG. 7 is a partial view, in enlarged cross section, at the closed end of a cylindrical-configuration drawn cup-shaped work product for further describing relative positioning of such axially-recessed circular-configuration endwall preformed bead FIG. 5.

FIGS. 6 and 7 depict the preformed axially-recessed bead 74 in greater detail. The objective in preforming a circular-configuration (FIG. 6) bead is to predispose sheet metal so as to enable buckle-free shaping of sheet metal at closed end 46 (FIG. 1) of can body 44 being fabricated for pressurized beverage packs. Such closed end shaping had previously presented difficulties.

For example, an economy measure in recent years has been to decrease the diameter of easy-open pour-feature end closures for one-piece can body pressurized beverage packs. As a result, for stacking purposes, the diameter requirement for a can body "base support" has been decreasing; and problems in providing desired closed end characteristics have been increasing. Economizing on such easy-open ends requires a significantly smaller support base diameter than the diameter of the sidewall of the can body. And both diameters can vary with the capacity of the can, such as twelve or sixteen ounce, or with the desired can body height. Fabricating a decreased diameter base support, as taught herein, facilitates fabricating and achieving desired closed end characteristics for pressurized beverage packs.

The invention provides a base support, which projects axially uniformly significantly beyond the cylindrical-configuration ironed sidewall adjoining the closed end of the can body. And, further, avoids any significant thinning of sheet metal at such closed end so as: to avoid sheet metal buckling during shaping of such closed end, to enable selection of desired base support diameter to avoid any requirement for reforming the closed end after can body fabrication, and to provide desired bulge and implosion resistance at the closed end of the can body.

The placement of recessed bead 74 and its radially-inwardly-located diameter are preselected. Such diameter is selected in relation to, and is slightly larger than, the diameter at the location selected for the support base of the closed end for the pressure pack can body being fabricated.

The drawn cup-shaped work product partially shown in radial cross section in FIGS. 4 and 5, has an endwall (including bead 74) which is substantially at starting thickness gauge. The thickness gauge of sidewall 73 is substantially equal to starting gauge. In a redraw within bodymaker 30, the sheet metal at such closed end is maintained at starting gauge and the sidewall sheet metal can remain substantially at starting gauge, prior to sidewall ironing in such bodymaker.

However, subsequent to such bodymaker redraw, the sidewall height is substantially increased by thinning sidewall sheet metal during passage through in-line ironing means. In a bodymaker, a redraw punch also serves as an ironing punch, since the bodymaker redraw (to a smaller diameter than cup 63) and the sidewall ironing take place as part of a single bodymaker work stroke.

Figure 8:
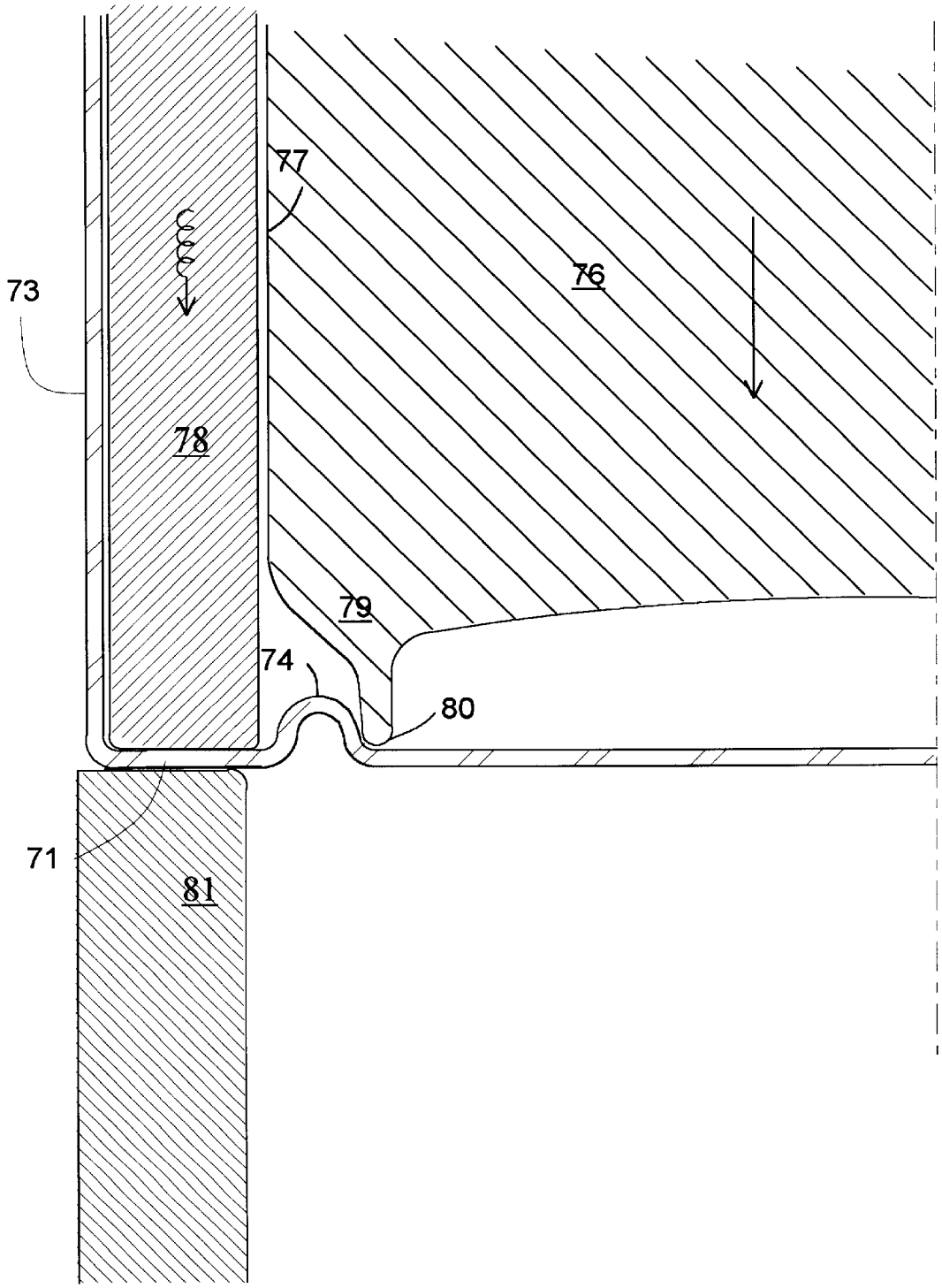
FIGS. 8 and 9 are schematic partial views, in radially-oriented cross section, for describing redraw apparatus in which such axially-recessed endwall preform of FIG. 7 is unfolding accordance with the invention.
Figure 9:
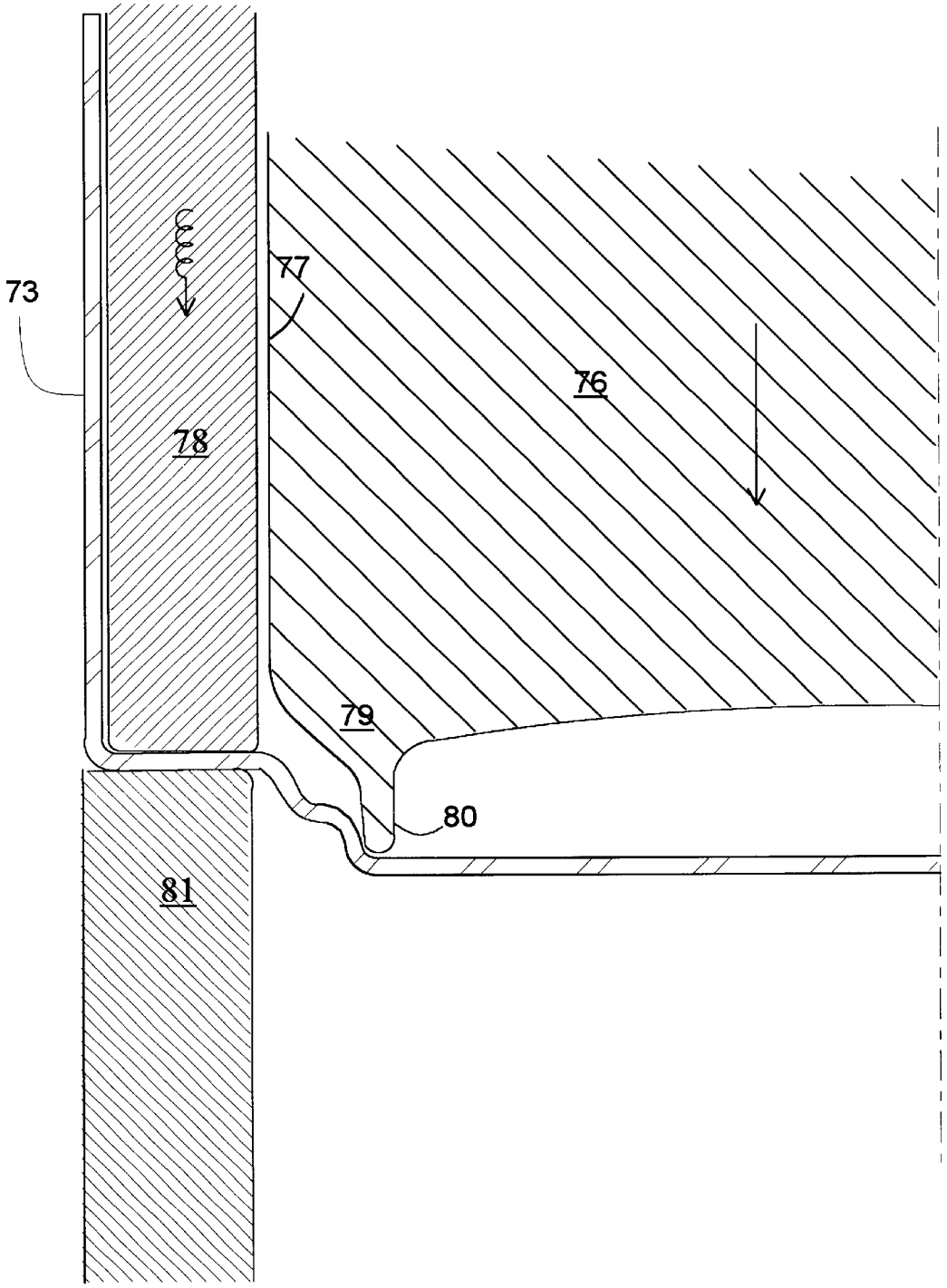
Figure 10:
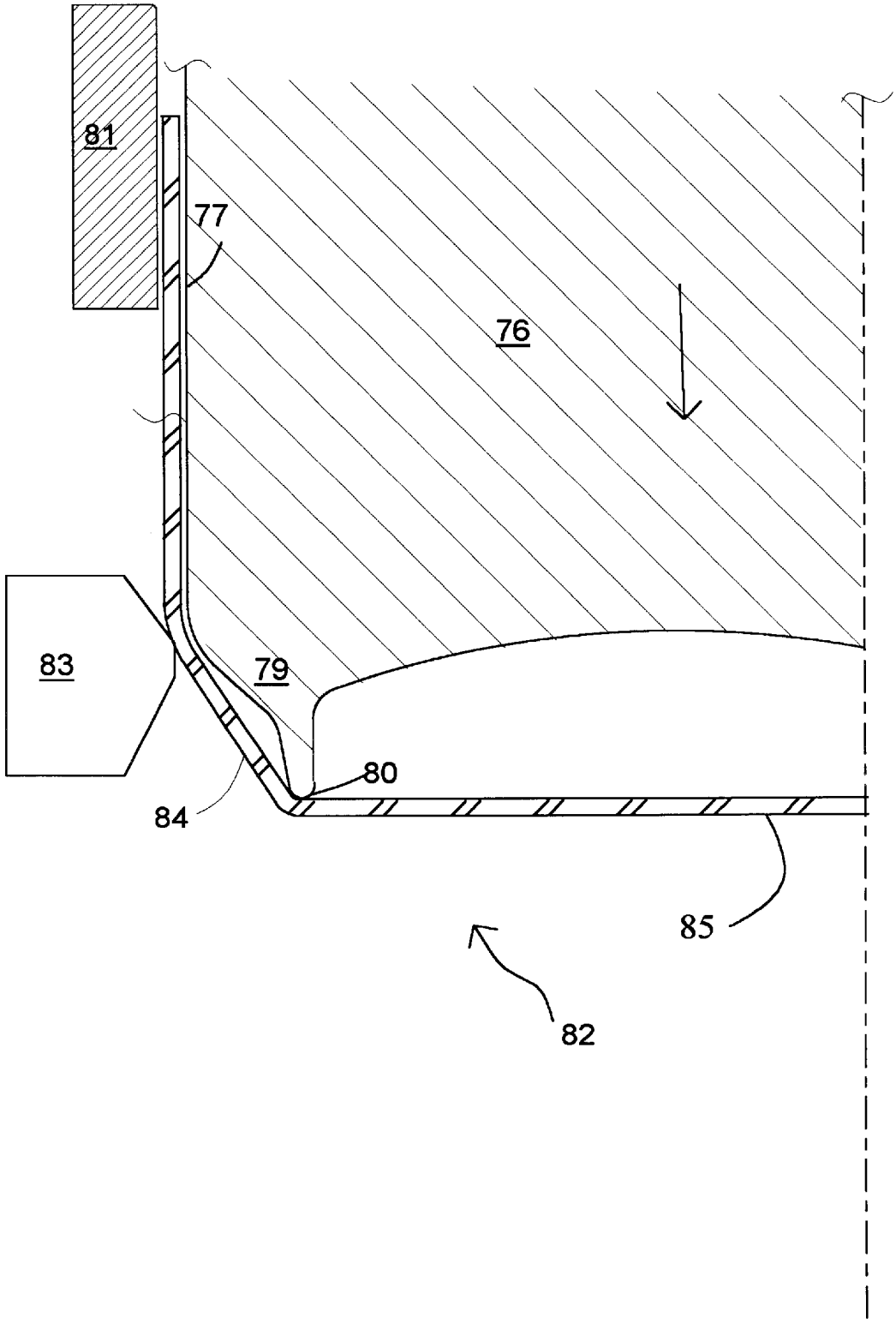
FIG. 10 is a schematic partial view, in radially-oriented cross section, of tooling internally and externally of a redrawn cup-shaped work product upon completing such redraw of FIG. 9, in preparation for sidewall elongation by ironing in accordance with the invention.

As shown in FIGS. 8–10, bodymaker punch 76 has a cylindrical sidewall 77 of uniform outer diameter; such outer diameter is substantially equal to the internal diameter of the pressure pack can body being fabricated. The radial dimension of the drawn cup endwall portion 71 (FIG. 8), which is located radially outwardly of recessed bead 74, is selected to provide for the redraw decrease in radius; and is approximately equal to the radial dimension of redraw clamping sleeve 78 (FIGS. 8, 9). During the bodymaker redraw, the decrease in radial dimension of the endwall of the drawn cup is added to the height of the bodymaker redrawn cup sidewall; such sidewall height increase can be carried out without substantially changing the thickness gauge of such sidewall.

In addition to sidewall 77, the bodymaker punch 76 presents closed end profiling tooling which includes a protruding portion, with a nose-like configuration in radial cross section, as shown in FIGS. 8, 9. Such nose-shaped tooling 79 has a distal end defining a curved surface 80. The diameter at such distal end and the curved surface 80 configuration are selected to provide a closed end base support, as referred to above, of desired diameter for the finished can body. Such protruding tooling 79 also defines a radially outwardly-located angled portion of the closed end leading to the sidewall of the finished can body.

The radial cross-sectional dimensional relationships of such closed end profiling tooling 79 and the preformed axially-recessed bead 74 are shown in FIG. 8. The diameter of the drawn work product sidewall 73 is decreased during the bodymaker redraw of FIGS. 8, 9. One half of such diameter decrease is indicated by the radial dimension of clamping ring 78 which is mounted internally of the drawn cup shown in FIG. 7. The bodymaker redraw is carried out by movement, as indicated in FIGS. 8, 9, of redraw/ironing punch 76 in relation to and within the cavity of redraw die 81.

The sheet metal of axially-recessed bead 74 (shown in FIG. 8) is unfolding during such bodymaker redraw as partially shown in FIG. 9. Such radially-outwardly unfolding is facilitated by the cross-sectional shape of bead 74 which is slightly asymmetrical in the radially-outward direction, as shown in FIG. 7. Such unfolding sheet metal is extended from distal end 80, in an angled relationship (as seen in cross section), toward the open end of the cup-shaped product and toward the contiguous juncture of bodymaker punch sidewall 77 with closed end profiling tool 79. That is, as such redraw is completed, sheet metal previously part of bead 74 extends as shown in FIG. 10.

As the sidewall of bodymaker redrawn cup 82 (FIG. 10) is approaching a first ironing ring 83, the unfolded sheet metal of such earlier-depicted axially-recessed bead 74 extends, as indicated at 84, in a radially outwardly-angled manner adjacent to but slightly spaced from the radially exterior curved surface of profiling tooling 79. A substantially-planar endwall panel 85, located radially inwardly of distal end 80, and such angled portion 84 remain at sheet metal starting thickness gauge.

Figure 11:
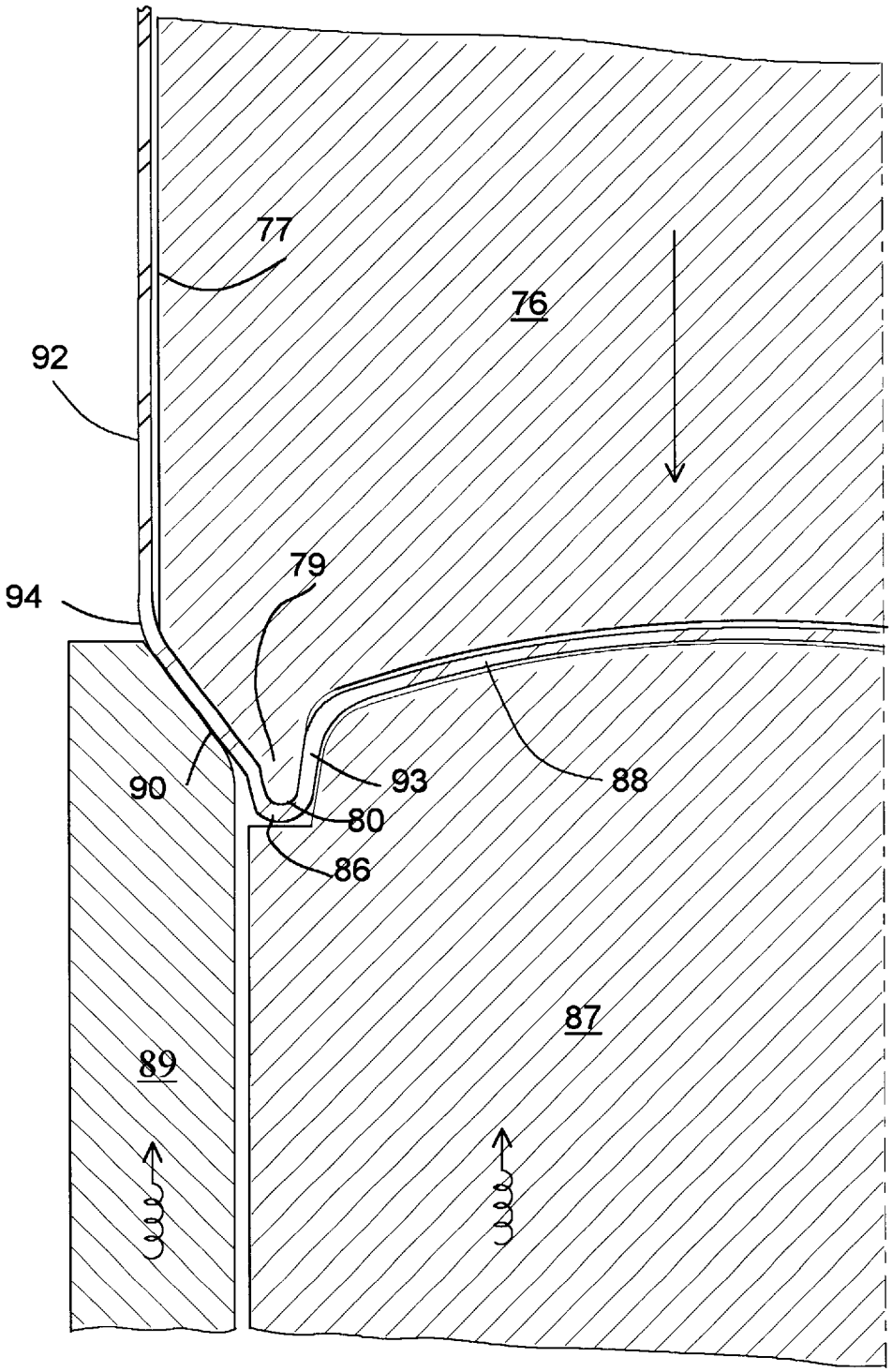
FIG. 11 is a schematic cross-sectional radially-oriented partial view for describing internally and externally located closed end shaping tooling and multiple steps of the invention for completing closed end profiling for a pressurized beverage can body, subsequent to such sidewall ironing elongation.

The final desired shaping at the closed end of the can body is carried out upon completion of sidewall ironing and release of sidewall ironing tension. The tooling for such final shaping of the closed end is depicted in FIG. 11. Projecting nose-like tooling 79 maintains a circular-configuration (in plan view) at base support centerline diameter 86, established by distal end 80 of internally-located profiling tool 79 of bodymaker punch 76. An endwall portion of the bodymaker punch has a concave arc-shaped central portion, located radially inwardly of distal end 80. Such concave portion can be machined in bodymaker punch 76, or can be presented for closed end shaping, by disposing an added insert (not shown) in an essentially cylindrical-configuration endwall opening in the bodymaker punch. That concave arc-shaped endwall portion coacts with closed end tooling mounted externally of the can body to shape endwall panel 85 of FIG. 10.

An externally-mounted endwall panel shaping tool 87 is spring-loaded, as indicated in FIG. 11, to provide a uniform-arc dome shape 88 in the sheet metal of closed end of the can body. Spring-loaded clamping sleeve 89 presents a shaped surface 90, which is angled directionally toward the open end of the can body and such contiguous portion of ironed sidewall 92. The contour of surface 90 matches that of the radially outward profiling surface of nose-like tool 79.

As sidewall ironing is completed and the sheet metal of sidewall 92 has been released from axial tension, shaping of the closed end is carried out with the tooling of FIG. 11. The tensile strength of the flat-rolled steel (such as double-reduced DR8, DR9) is selected such that the movement of sidewall sheet metal enables planar panel 85 (FIG. 10) to be shaped into dome 88 (FIG. 11). The height of sidewall 92 is decreased. That is, ironed sidewall sheet metal, guided by shaped surface 90 of sleeve 89, is moved into the closed end toward distal end curved surface 80 during shaping of dome 88. Such movement of sidewall metal into the closed end helps to release adhesion of ironed sidewall 92 with the sidewall 77 of the bodymaker punch.

The thickness gauge of the closed end sheet metal is not significantly decreased; but, rather, is maintained during movement of sidewall metal into such closed end. Shaping of the closed end sheet metal is achieved, free of buckling, as sidewall sheet metal guided by shaped surface 90 (FIG. 11) moves toward such concave dome-shaped portion 88 of the closed end.

The linear dimension of the sheet metal in the previously-described axially-recessed bead 74 is preselected to substantially extend from the curved surface formed by distal end 80, contiguous to base support centerline diameter 86, to contiguous sidewall 92 at juncture 94. Tooling dimensions, bead size and location, and metallurgical characteristics of the selected flat-rolled can stock are interrelated and coordinated to provide such profiling, free of buckling of the sheet metal. And, as previously set forth, the movement of sidewall sheet metal into the closed end is carried out without significant decrease in sheet metal gauge at closed end 95 (FIG. 12) of the can body.

Figure 12:
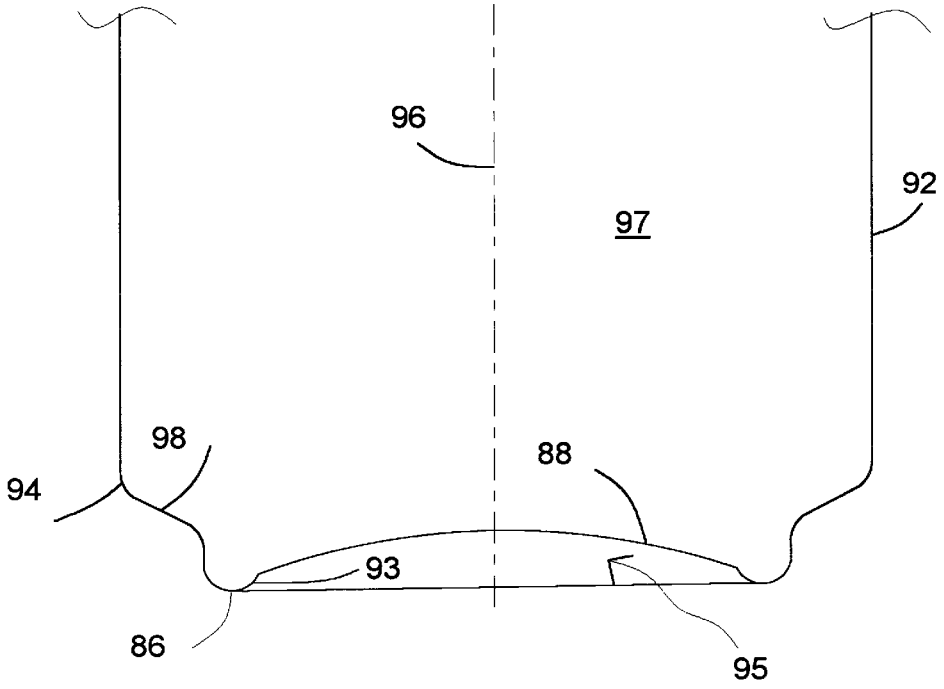
FIG. 12 is a schematic partial view, in axially-oriented cross section, of a closed end embodiment of the invention, formed as described herein.

Such closed end presents a circular-configuration (in plan view) base support 86, which uniformly projects axially beyond the cylindrical-configuration sidewall 92 of the can body. The base support 86 and closed end 95 are symmetrical in relation to central longitudinal axis 96 of can body 97 (FIGS. 12, 13). The closed end, which is substantially at starting thickness gauge, contributes strength and support which are particularly important for pressure-pack beverage cans.

Angled portion 98 (FIG. 12) of the closed end extends radially outwardly, in relation to the central longitudinal axis 96 of the can body, angled in the direction of the open end and the contiguous sidewall of the can body. That is, such angled sheet metal conforms to the radially-outwardly located contour of the closed end tooling, from such projecting base support 86 toward cylindrical sidewall 92; and intersects such sidewall contiguous to the closed end at unitary juncture 94. Such profiled configuration at closed end 95 provides base support and strength, and provides a base support diameter for nesting and stacking of the base support 86 within a chime seam for an open end closure structure, of preselected diameter, at the longitudinally opposite end of a can body for a pressurized beverage pack.

Referring to FIG. 13, flange metal 104 circumscribes circular-configuration open end 106, providing sheet metal for a chime seam to secure a preselected diameter end closure structure to a filled can body. A necked-in portion 108, contiguous to open end 106, has dimensional characteristics chosen in relation to the preselected diameter for an end closure structure. The latter is secured by a standard chime seaming operation to the can body open end at chime seam 110 (shown in FIG. 14). The diameter of base support 86 is provided to enable interfitting for stacking purposes.

In the illustrated embodiment of FIG. 14, cans with corresponding configuration can bodies fabricated as taught herein, enable interfitting of axially projecting base support 86 within such chime seam 110. The projecting support base 86 is contiguous to recessed panel 112 (shown in interrupted lines in FIG. 14) for stacking such next adjacent can. A stable vertical stacking arrangement is provided by distortion-free high-strength closed end can bodies in which the diameter of such base support 86 can be provided in a range from about two and two-sixteenths inches (202) to about two and six sixteenths inches (206) for a twelve ounce pressurized beverage can having a height of about four and thirteen sixteenths inches (413).

Smaller or larger-diameter cans of the same capacity can, using present teachings, provide differing base support diameters, and larger capacity pressurized beverage packs can be provided with a larger-diameter base support which is related to a larger-diameter sidewall. The distortion-free high-strength closed end of the invention provides for such differing sizes, facilitates stable conveyance of pressurized beverage cans and, also, facilities stable handling of can bodies for such cans during processing.

Flat-rolled steel is double reduced without an intermediate anneal to provide a tensile strength in the range of about seventy-five thousand pounds per square inch (75 KSI, nominal DR8) to about one hundred ten thousand pounds per square inch (110 KSI, nominal DR9). The thickness gauge for such can stock for can bodies for pressurized beverage packs can be from about nominal sixty pounds per base box to about nominal ninety-five pounds per base box. Nominal thickness gauge allows for a variation of about ten percent.

The following table presents metallurgical and dimensional data for a flat-rolled steel embodiment of the invention. The double-reduced flat-rolled steel of such embodiment is cold-reduced about thirty to forty percent, without an anneal, and has an electrolytic tinplating weight of about a quarter pound to about a half pound per base box.

TABULATED DATA

| Double Reduced (DR) Flat-Rolled Steel | |
|---|---|
| Sheet Metal: | |
| Starting Gauge (Nominal) | 60 to 95#/bb |
| Tensile Strength | 75 to 100 KSI* |
| Blank Diameter | 5.506" |
| Drawn Cup: | |
| Diameter | 3.58" |
| Height | 1.3" |

-continued

| TABULATED DATA | |
|---|---|
| Double Reduced (DR) Flat-Rolled Steel | |
| Recessed Bead: | |
| C/L Diameter | 2.21" |
| Inner Diameter | 2.028" |
| Outer Diameter | 2.481" |
| Entrance Radius For Each | 0.050" |
| Axial Depth | .075–.085" |
| Bottom Radius | 0.080" |
| Redrawn Cup: | |
| Diameter | 2.59" |
| Height | 2.63" |
| Punch 76: | |
| Radius of Curved Surface 80 at 86 | 0.034" |
| C/L Diameter of Curved Surface 80 | 1.90" |
| Axial Dimension From Plane of 86 To Plane of Sidewall Juncture at 94 | 0.346" |
| Finished Can Body: | |
| Height | 413** |
| Sidewall Diameter | 211 |
| Base Support Range of Diameters | 202–206 |
| Necked-in Chime Seam: | |
| Diameter Range | 202–206 |

*(KSI = 1000 lbs/sq. in.)
**(Four and thirteen sixteenths inches)

Specific configurations, dimensions, arrangements, and metallurgical characteristics have been set forth for purposes of describing the invention. However, it should be recognized that changes in specific configurations, dimensions and arrangements are available to those skilled in the art, in light of the above teachings, while continuing to rely on novel precepts and teachings of the above disclosure. Therefore, in determining the scope of the present invention, reference shall be made to the accompanying claims.

What is claimed is:

1. Process for fabricating a one-piece sheet metal can body, of predetermined internal diameter, with a closed-end configuration defining a base support for a two-piece can for use in a pressurized-beverage pack, comprising A. providing a planar blank of flat-rolled sheet metal having tensile strength above a selected level, such blank having a circular-configuration cut edge of predetermined diameter, and a substantially uniform starting thickness gauge throughout such planar sheet metal blank area;

B. draw forming such flat-rolled sheet metal blank into a shallow-depth cylindrical configuration one-piece drawn cup having a closed end and an open end with a centrally-located axis extending therebetween, such drawn cup presenting:

(i) a substantially-planar circular configuration endwall, of predetermined diameter at such closed end, in which sheet metal is at such preselected starting gauge, (ii) a cylindrical-configuration sidewall in which sheet metal gauge does not exceed such preselected starting gauge, with such sidewall sheet metal extending toward the open end of the drawn cup in symmetrical relationship to such centrally-located axis, and (iii) a unitary juncture, extending between such planar endwall and cylindrical-configuration sidewall at the closed end of such cup, in which sheet metal does not exceed such preselected starting gauge; then, after completion of such cup sidewall, C. preforming a bead, having a circular-configuration in plan view, in such cup endwall, by (i) selecting tensile strength of such sheet metal such that preforming such bead pulls sheet metal from such sidewall into such endwall producing a uniformly axially-recessed bead internally of such drawn cup, with (ii) such endwall and such circular configuration bead, as formed, being substantially free of decrease in thickness gauge of sheet metal, and with (iii) such circular-configuration axially-recessed bead being preformed:

to have a predetermined diameter, and so as to be predeterminedly located uniformly spaced radially-inwardly from a projection of such cylindrical-configuration sidewall onto a plane defined by such planar endwall of such drawn cup; then D. directing such drawn cup, with such predeterminedly-located axially-recessed bead, into bodymaker apparatus having a single elongated plunger for carrying out redrawing of such cup and sidewall ironing in a single work stroke for carrying out redraw of such drawn cup in such bodymaker apparatus to form a circular configuration redrawn cup of decreased diameter and increased height with respect to such drawn cup, by (i) positioning such single elongated plunger of such bodymaker apparatus to project axially inwardly internally of such drawn cup, (ii) locating clamping ring means coaxially with respect to such plunger internally of such drawn cup, and (iii) locating redraw die means externally of such drawn cup; with such bodymaker plunger, as projecting axially inwardly within such drawn cup, presenting:

(a) a cylindrical configuration outer wall of predetermined diameter establishing such predetermined internal diameter for both such redrawn cup and such can body being prepared for assembly of a two-piece can, and (b) closed-end shaping tooling, disposed internally of the drawn cup, to project in confronting relationship to such drawn cup endwall on its internal surface;

E. symmetrically disposing such internal closed-end shaping tooling coaxially with such centrally-located axis of such drawn cup, so as to present (i) an axially protruding portion having a nose-like configuration in a radially-oriented cross-sectional plane which includes such central axis, such axially protruding portion presenting:

(ii) a distal end of circular configuration in plan view for defining such base support, for such pressurized-beverage can pack, in such can body being fabricated, and (iii) a surface which is disposed radially outwardly of such distal end, in such cross-sectional plane, such circular-configuration distal end within such nose portion diameter presenting a concave dome-shaped curved surface for confronting the endwall surface internally of such drawn cup, such dome-shaped curved-surface being symmetrical in plan view with respect to such centerline axis of such distal end;

F. preselecting diameters of such circular-configuration preformed bead and such circular-configuration distal end of such internal closed-end shaping tooling such that the distal end internal tooling contacts such drawn cup endwall surface radially inward of, and contiguous to, such axially-recessed bead at a location where sheet metal of such recessed bead returns to a substantially-planar configuration end wall panel of circular-configuration located radially inwardly of such bead;

G. (i) carrying out redraw of such drawn cup in such bodymaker apparatus by decreasing endwall diameter of such drawn cup and increasing sidewall height, (ii) producing a unitary redrawn cup having an open end and closed end and a decreased-diameter cylindrical configuration sidewall of increased height in relation to such first drawn cup sidewall which is symmetrically disposed with relation to a centrally-located longitudinal axis extending between such open end and closed end, while (iii) locating such internally-disposed closed-end shaping tooling so as to enable buckle-free unfolding of sheet metal of such recessed bead during forming of a diameter-decreased redrawn cup sidewall in such bodymaker, and in which (iv) such unfolding bead sheet metal extends, in angled relationship to such central axis, from contact with such closed-end axially-protruding circular-configuration distal end toward such redrawn cup sidewall, such angled-relationship sheet metal having (a) an axially-directed component directed toward such open-end of the redrawn cup, and (b) a radially-directed component directed toward such redrawn cylindrical sidewall for contact with such redrawn sidewall at a location contiguous to such closed end; with such redrawn cup presenting:

a substantially-planar closed endwall panel located radially inwardly of contact of such circular-configuration distal end of such redrawn cup, and a cylindrical sidewall having an internal diameter substantially equal to such predetermined internal diameter cylindrical sidewall for such can body being prepared for assembly of such two-piece can; then, while H. maintaining positioning of such internally-disposed closed end shaping tool with its centrally located axis coextensive with such centrally located axis of such bodymaker redrawn cup, I. ironing sidewall sheet metal of such bodymaker redrawn cup to a can body of desired height, by passing such redrawn cup, while mounted on such single elongated bodymaker plunger, through sidewall ironing ring means of selected internal diameter less than such diameter of such bodymaker redraw die cavity and greater than the external diameter of such bodymaker plunger, and then, after such ironing step is completed, and such ironed sidewall is free of such ironing ring means, J. finishing shaping of such closed end of such ironed-sidewall can body by:

providing for solely axial movement of externally-mounted closed end shaping tooling, including (a) shaped-surface tooling for such sheet metal extending radially outwardly in angled relationship from such endwall contact with circular-configuration distal end contact toward such sidewall, and (b) profiling tooling presenting a uniformly-curved convex dome-shape, having a circular-configuration periphery which, as disposed in an axial direction, is radially inwardly and contiguous to such curved surface at such circular-configuration distal end of such internally-disposed tooling, with such axial relative movement of such externally-mounted closed-end shaping tooling establishing contact with such substantially-planar closed endwall panel sheet metal, on its external surface, so as to form such sheet metal of such planar endwall panel into a concave dome of uniformly-curved configuration disposed radially inwardly of such circular-configuration distal end diameter, such shaping of the substantially-planar closed endwall panel sheet metal of such ironed sidewall can body taking place while such ironed sidewall is free of any contact with such ironing ring means, so as to provide for (i) facilitating movement of sheet metal, from such ironed sidewall into such closed end of such ironed sidewall work product, (ii) diminishing ironed sidewall adhesion with such bodymaker plunger, and (iii) conforming such closed end configuration of such sidewall-ironed can body to such externally-mounted closed-end shaping tooling, including such bodymaker plunger closed-end shaping tooling.

2. The process of claim 1, including selecting flat-rolled steel sheet metal to have sufficient tensile strength to provide for finishing shaping of such closed end of such ironed-sidewall can body, including such concave dome, by pulling sidewall sheet metal into such closed end, substantially free of a decrease in closed-end sheet metal thickness gauge.

3. The process of claim 2, comprising selecting flat-rolled steel which has been double-reduced in thickness gauge, free of an intermediate annealing treatment, to have a thickness gauge in the range of about 60 to about 90 lbs/bb and a tensile strength in the range of about 75 to about 100 ksi.

4. The process of claim 2 or 3, including selecting an electrolytic metal plating for such circular-configuration flat-rolled steel sheet metal blank from the group consisting of tin and nickel-zinc.

5. A flat-rolled sheet metal can body, having a height of about five inches and a main body sidewall diameter of about two and eleven sixteenths inches, fabricated in accordance with the process of claim 1 or 2.

* * * * *